US007669619B2

(12) United States Patent
Sun

(10) Patent No.: US 7,669,619 B2
(45) Date of Patent: Mar. 2, 2010

(54) ELECTRIC PENCIL SHARPENER

(75) Inventor: Hongtao Sun, Shenzhen (CN)

(73) Assignee: Yurisheng Electronic (Shenzhen) Co., Ltd, Shenzhen (CN)

( * ) Notice: Subject to any disclaimer, the term of this patent is extended or adjusted under 35 U.S.C. 154(b) by 365 days.

(21) Appl. No.: 11/688,885

(22) Filed: Mar. 21, 2007

(65) Prior Publication Data

US 2008/0149220 A1 Jun. 26, 2008

(30) Foreign Application Priority Data

Dec. 26, 2006 (CN) ..... 2006 1 0157792

(51) Int. Cl.
*B43L 23/02* (2006.01)
*B43L 23/08* (2006.01)

(52) U.S. Cl. ..... 144/28.72; 144/28.8; 144/28.9

(58) Field of Classification Search ..... 144/28.1, 144/28.3–28.9; 30/451, 453–457, 459, 461, 30/462

See application file for complete search history.

(56) References Cited

U.S. PATENT DOCUMENTS 1,902,844 A * 3/1933 Fiset ..... 451/503
4,918,816 A * 4/1990 Alpha ..... 30/452
6,065,514 A * 5/2000 New ..... 144/28.5

* cited by examiner

*Primary Examiner*—Shelley Self

(57) ABSTRACT

An electric pencil sharpener includes a frame, a first motor, a first transmission mechanism driven by the first motor, and a continuing feeding mechanism. The feeding mechanism includes a roller, a feeding wheel rotatably mounted to the frame and driven by the first transmission mechanism, and a driving assembly. An end of the driving assembly is driven by the first transmission mechanism, and the other end of the driving assembly is connected to the roller. The roller defines a groove in a bottom thereof, for pencils falling through. The feeding wheel defines a plurality of receiving slots each for receiving a pencil. The roller is driven by the driving assembly to swing, when the groove of the roller aligns with one of the receiving slots of the roller. Thus, a pencil falls into the receiving slot.

10 Claims, 6 Drawing Sheets

ELECTRIC PENCIL SHARPENER

BACKGROUND OF THE INVENTION

The present invention relates to pencil sharpeners, and particularly to an electric pencil sharpener automatically continuing to sharpen pencils.

Currently, an additional electric pencil sharpener includes a motor, a transmission mechanism, and a sharpening mechanism. When a pencil is inserted into the electric pencil sharpener, the transmission mechanism is driven by the motor to work, and a cutter of the sharpening mechanism rotates to automatically sharpen the pencil. However, such pencil sharpener is incapable of sharpening pencils continuously. The pencils must be replaced one by one by operators, which is inefficient.

What is needed is to provide an electric pencil sharpener that automatically continues to sharpen pencils.

BRIEF SUMMARY OF THE INVENTION

An exemplary electric pencil sharpener includes a frame, a first motor, a first transmission mechanism driven by the first motor, and a continuing feeding mechanism. The feeding mechanism includes a roller, a feeding wheel rotatably mounted to the frame and driven by the first transmission mechanism, and a driving assembly. An end of the driving assembly is driven by the first transmission mechanism, and the other end of the driving assembly is connected to the roller. The roller defines a groove in a bottom thereof, for pencils falling through. The feeding wheel defines a plurality of receiving slots each for receiving a pencil. The roller is driven by the driving assembly to swing, when the groove of the roller aligns with one of the receiving slots of the roller. Thus, a pencil falls into the receiving slot.

Other objects, advantages and novel features of the invention will become more apparent from the following detailed description when taken in conjunction with the accompanying drawings, in which:

DETAILED DESCRIPTION OF THE INVENTION

Figure 1:
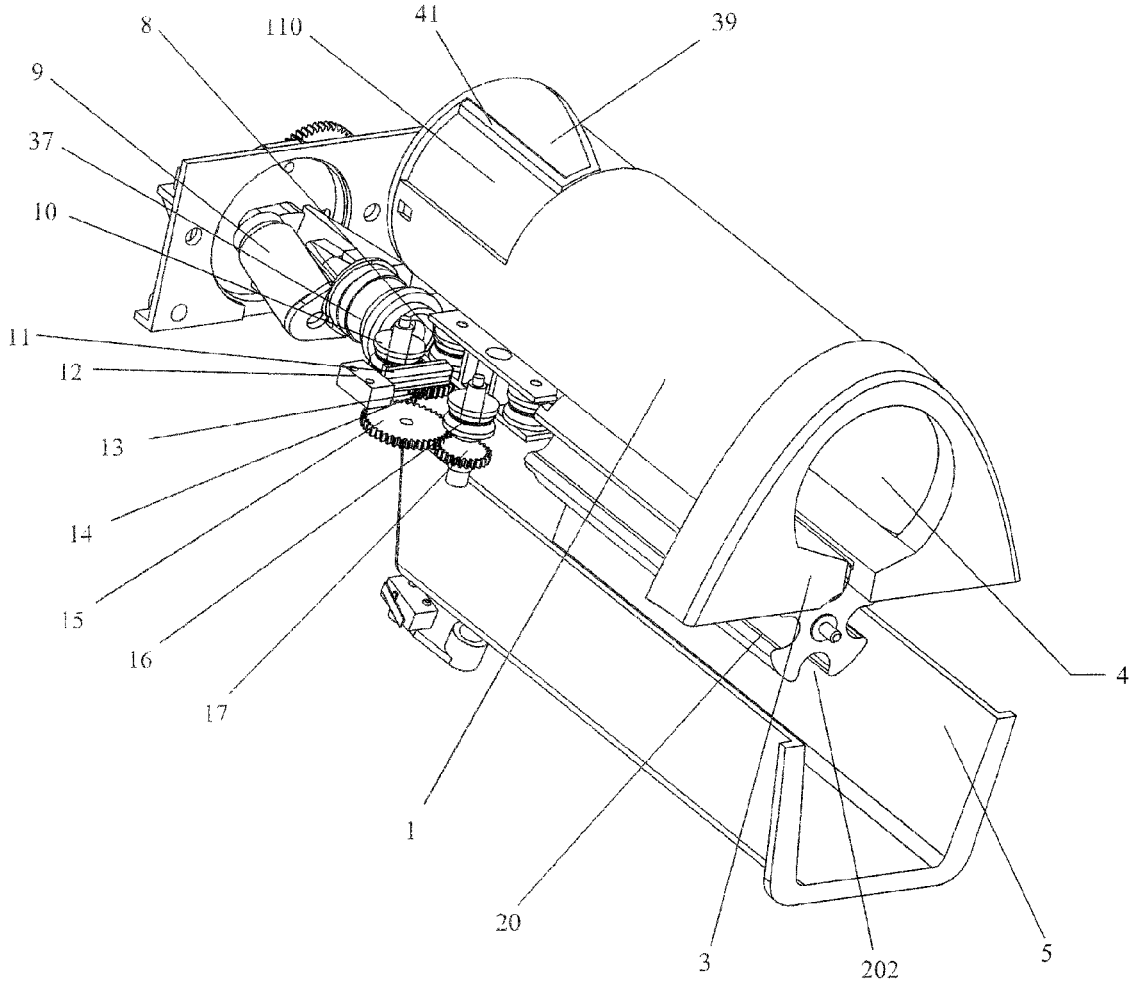
FIG. 1 is an exploded, isometric view of an electric pencil sharpener in accordance with a preferred embodiment of the present invention, the electric pencil sharpener includes a roller.
Figure 2:
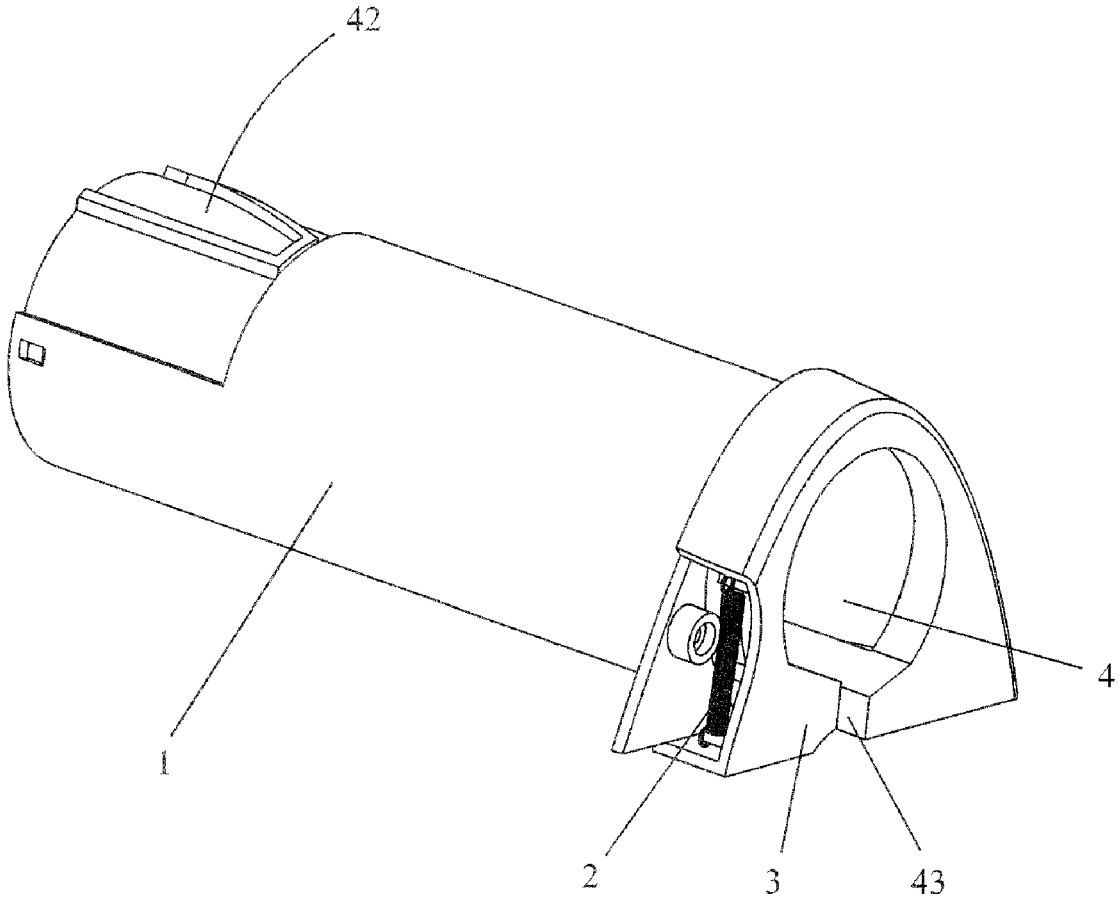
FIG. 2 is an isometric view of the roller of FIG. 1.
Figure 3:
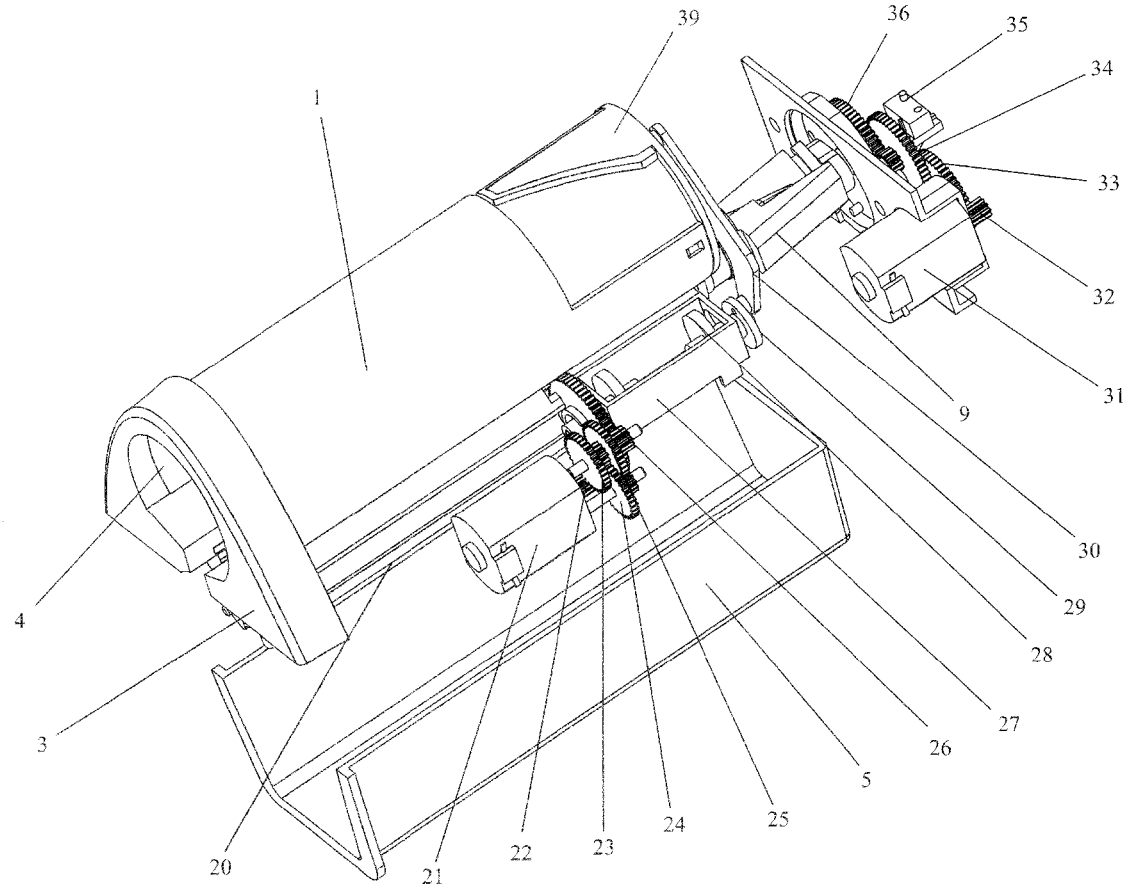
FIG. 3 is similar to FIG. 1, but viewed from another aspect.
Figure 4:
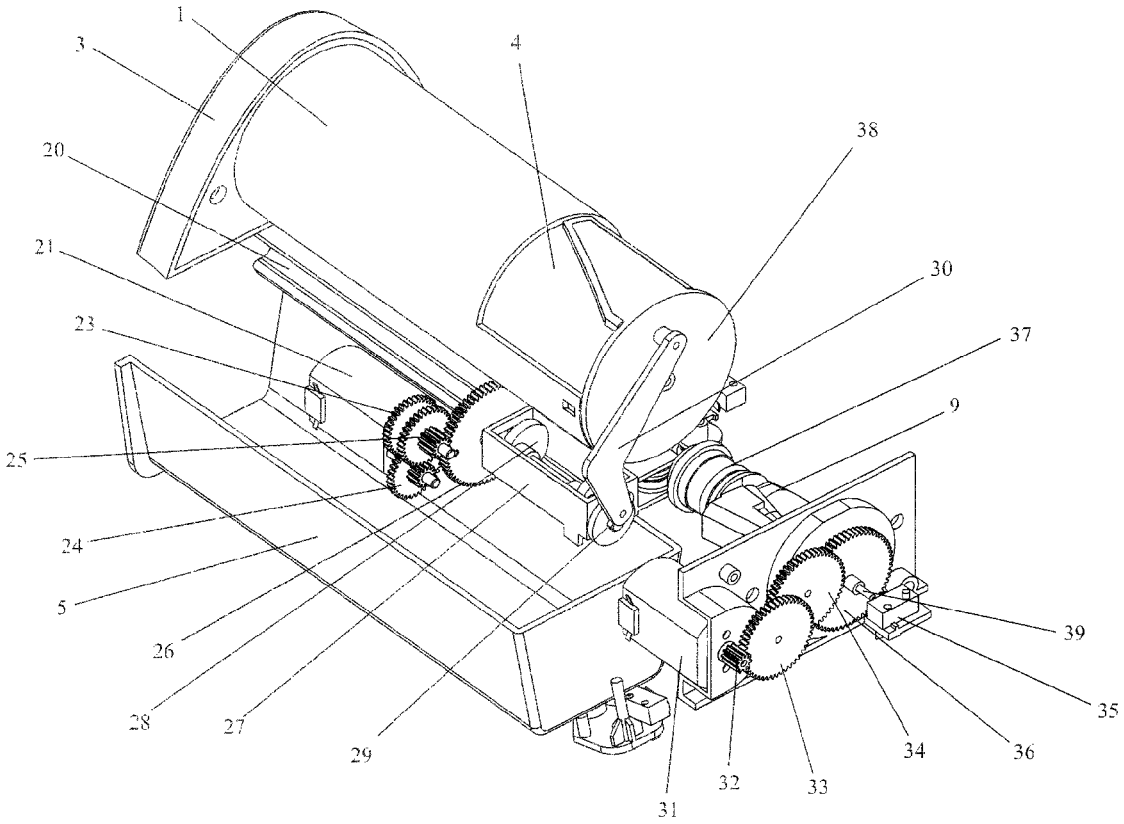
FIG. 4 is similar to FIG. 1, but viewed from another aspect.
Figure 5:
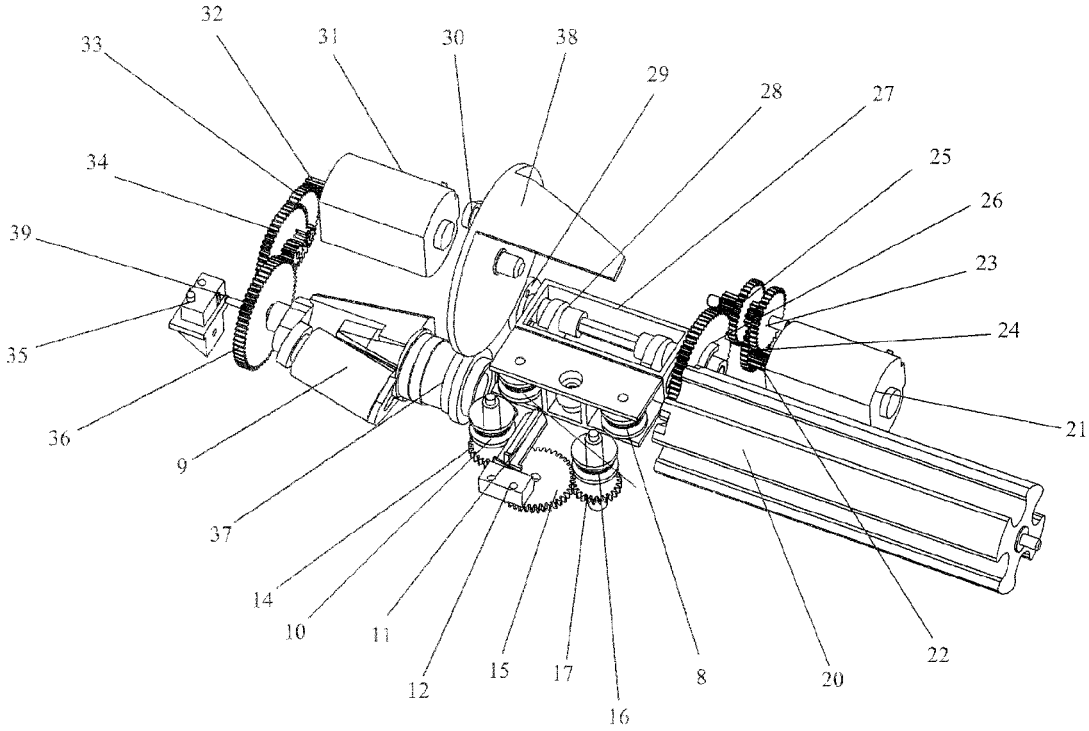
FIG. 5 is an isometric view of a part of FIG. 1, but viewed from another aspect.
Figure 6:
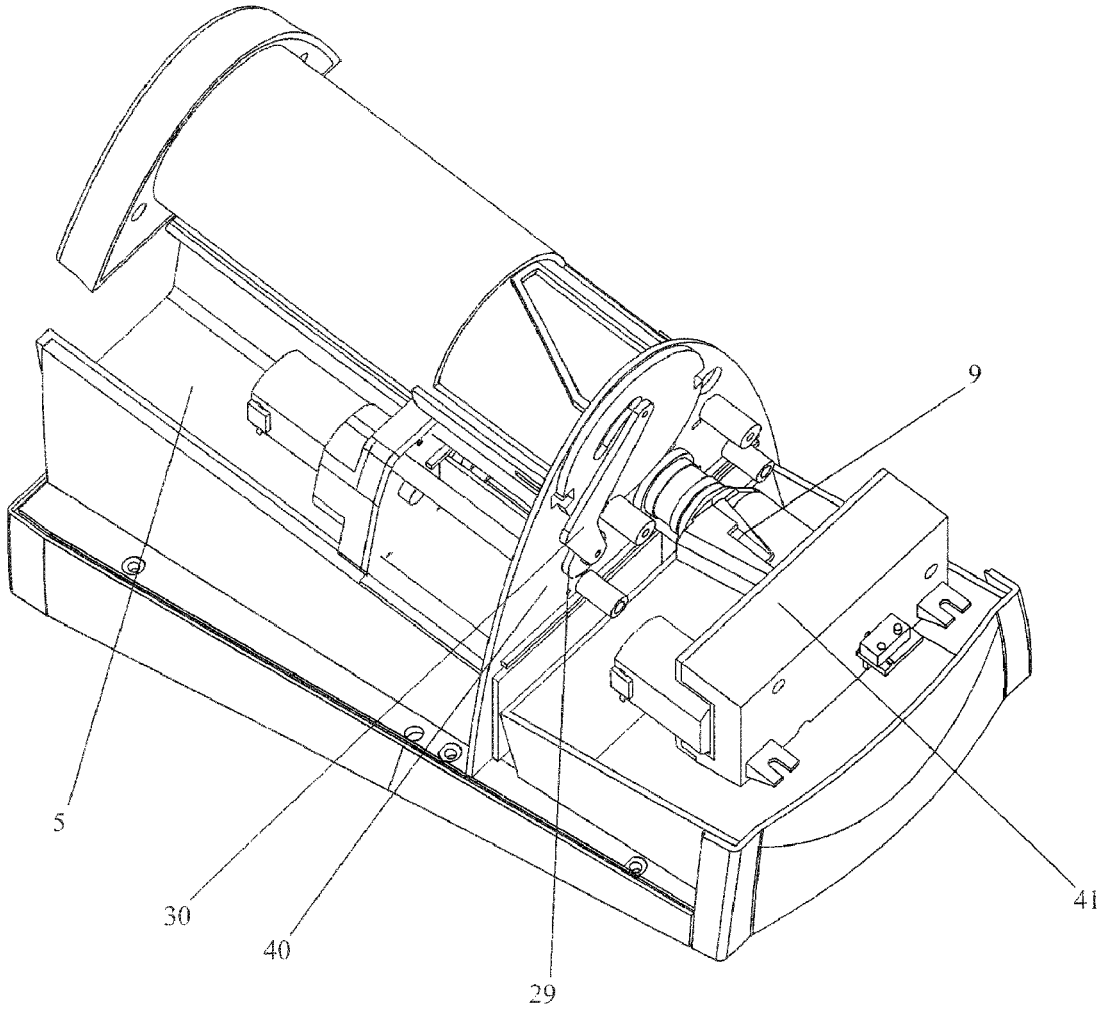
FIG. 6 is an assembled view of FIG. 1.

Referring to FIGS. 1 to 6, an electronic pencil sharpener in accordance with a preferred embodiment of the present invention includes a frame 40, two motors 21, 31, a first and a second transmission mechanisms driven by the motors 21, 31 respectively, a continuing feeding mechanism and a pencil clamping mechanism driven by the first transmission mechanism, a sharpening mechanism and a feeding mechanism driven by the second transmission mechanism, and a pencil container 5 mounted to the frame 40.

The continuing feeding mechanism includes a first gear assembly driven by the first transmission, a roller 4 driven by the first gear assembly (gears 22, 23, 24, 25, 26), a feeding wheel 20, an eccenter 29, a connecting bar 30, and a drawing wheel 38. The feeding wheel 20 defines a plurality of receiving slots 202 in a circumference thereof in an axial direction. Pencils are received in the roller 4, and one of them fails into a corresponding receiving slot 202 of the feeding wheel 20 when the roller 4 swings once. The feeding wheel 20 stops to rotate after rotating a determined angle, to wait for the pencil being cut. The feeding wheel 20 is rotatably mounted to the frame 40. The roller 4, a roller frame 1 that is mounted to the frame 40 for receiving the roller 4, and a cap 3 that is mounted to a front end of the roller frame 1 together form a pencil receiving roller assembly that is removable from the frame 40. The roller frame 1 defines a through-hole 110 therein. An extending portion 41 defining a locating hole 42 extends from the roller 4 into the through-hole 110. The extending portion 41 moving in the through-hole 110 limits the roller 4 to swing within an angle interval. A groove 43 is defined in a bottom of the roller 4, corresponding to the receiving slots 202 of the feeding wheel 20. An elastic member 2 is mounted between the roller 4 and the cap 3. The first gear assembly (gears 22, 23, 24, 25,26) is connected to the eccenter 29 via a hexangular shaft. An end of the connecting bar 30 is connected to the eccenter 29. An opposite end of the connecting bar 30 is connected to the drawing wheel 38. The drawing wheel 38 is pivotably mounted to the frame 40. The drawing wheel 38 includes a driving portion 39. The driving portion 39 engages in the locating hole 42 of the extending portion 41 of the roller 4, to drive the roller 4 to rotate. Thus, the eccenter 29, the connecting bar 30, and the drawing wheel 38 together form a driving assembly that drives the roller 4 to rotate.

The pencil clamping mechanism includes the first gear assembly, an eccenter 28 driven by the first gear assembly (gears 22, 23, 24, 25, 26), a draw rod 27 driven by the eccenter 28, a set of rubber driven wheels 8 mounted to the draw rod 27, and a set of drive wheels 10, 16 mounted to a main frame. The set of rubber drive wheels 10, 16 is driven by a second gear assembly (gears 13, 14, 15, 17). After the feeding wheel 20 is stopped to rotate, the first gear assembly (gears 22, 23, 24, 25, 26) driven by the first transmission mechanism drives the eccenter 28, the eccenter 28 drives the driven wheels 28 to move close to the drive wheels 10, to clamp a pencil between the set of driven wheels 8 and the set of drive wheels 10, 16.

The feeding mechanism sends a pencil to the sharpening mechanism to be sharpened. After the pencil is sharpened, the feeding mechanism reverses to send the pencil into a corresponding receiving slot 202 of the feeding wheel 20, and then the feeding wheel 20 rotates about a determined angle. Thus, the pencil falls into the pencil container 5 that is located below the feeding wheel 20. Meanwhile, another pencil is sent to the pencil clamping mechanism for a next sharpening.

The above-mentioned movements are continuously and circularly carried on once many pencils are put into the roller 4. The sharpened pencils are received in the pencil container 5, and then the electric pencil sharpener is laid off.

When the pencil receiving roller assembly is removed from the electric pencil sharpener, the elastic member 2 pulls the roller 4 to close the groove 43. A plurality of pencils is put in the roller 4, and then the pencil receiving roller assembly is put into the electric pencil sharpener. The drive portion 39 of the drawing wheel 38 cooperates with the extending portion 41 of the roller 4 to open the groove 43, and then one of the pencils falls into the feeding wheel 20. The electric pencil sharpener is started, the motor 21 starts to work and drive the eccentcr 29 to rotate via the first gear assembly (gears 22, 23, 24, 25, 26). The eccenter 29 drives the draw wheel 38 to rotate via the connecting bar 30. Thus, the roller rotates and detaches the pencil in the feeding wheel 20 from the other pencils in the roller 4. The gear 26 of the first gear assembly (gears 22, 23, 24, 25, 26) drives the feeding wheel 20 to rotate an angle, and then stop at a center of a crown gear 37. Meanwhile, the gear 26 drives the eccenter 28 to rotate, the eccenter 28 drives the draw rod 27 and two driven wheels 8 mounted to the draw rod 27 to move forward. The pencil is clamped between the set of drive wheels 10, 16, and the set of driven wheels 8. The motor 21 is stopped. The motor 31 starts to rotate to drive a sharpening gear assembly (gears 32, 33, 34, 36), the crown gear 37, and a cutter assembly 9 to positively rotate. The crown gear 37 drives the second gear assembly (gears 13, 14, 15, 17) to rotate. The second gear assembly drives the drive wheels 10, 16 to send the pencil to the cutter assembly 9 for being sharpened. After the pencil is sharpened, the cutter assembly 9 triggers a switch 35. The motor 31 reversely rotates to drive the sharpening gear assembly, the crown gear 37, and the cutter assembly 9 to reversely rotate. The crown gear 37 drives the second gear assembly (gears 13, 14, 15, 17) to reversely rotate. The second gear assembly (gears 13, 14, 15, 17) drives the drive wheels 10, 16 to reversely rotate and the pencil exits. Then, the pencil is sent to the feeding wheel 20. After the pencil exits, a pressure lever 11 of the switch 12 is released. The motor 31 is stopped. The motor 21 starts again to repeat the above-mentioned motion. After the feeding wheel 20 rotates the determined angle, the sharpened pencil falls into the pencil container 5. Meanwhile, another pencil is in place for being sharpened. The above-mentioned movements are continuously and circularly carried on, until all the pencils in the roller 4 are sharpened.

Once the cutter assembly 9 is worn out, the old cutter assembly 9 together with a sharpening mechanism that receives the cutter assembly 9 is removed from the electric pencil sharpener. The old cutter assembly 9 is removed from the sharpening mechanism, and a new cutter assembly is mounted to the sharpening mechanism. Then the sharpening mechanism is mounted to the electric pencil sharpener.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment of the invention.

What is claimed is:

1. An electric pencil sharpener, comprising:

a frame;

a first motor;

a cutter assembly;

a first transmission mechanism driven by the first motor; and a continuing feeding mechanism comprising a roller, a feeding wheel rotatably mounted to the frame and driven by the first transmission mechanism, and a driving assembly, an end of the driving assembly driven by the first transmission mechanism, the other end of the driving assembly connected to the roller, the roller defining a groove in a bottom thereof for pencils falling through, the feeding wheel defines a plurality of receiving slots each for receiving a pencil;

wherein the roller is driven by the driving assembly to swing, when the groove of the roller aligns with one of the receiving slots of the feeding wheel, a pencil falls into the receiving slot, to be sharpened by the cutter assembly.

2. The electric pencil sharpener as claimed in claim 1, wherein the continuing feeding mechanism further comprises a gear assembly driven by the first transmission mechanism, a gear of the gear assembly drives the feeding wheel to rotate.

3. The electric pencil sharpener as claimed in claim 2, wherein a corresponding end of the driving assembly is connected to the gear assembly that is driven by the first transmission mechanism.

4. The electric pencil sharpener as claimed in claim 3, wherein the driving assembly comprises a first eccenter, a connecting bar, and a drawing wheel, the gear assembly is connected to the first eccenter via a hexangular shaft, an end of the connecting bar is connected to the first eccenter, the other end of the connecting bar is connected to the drawing wheel, the drawing wheel is rotatably mounted to the frame.

5. The electric pencil sharpener as claimed in claim 4, wherein the drawing wheel comprises a driving portion, the roller comprises an extending portion, the driving portion is fixed to the extending portion to drive the roller to swing when the drawing wheel rotates.

6. The electric pencil sharpener as claimed in claim 1, wherein the receiving slots are regularly defined in a circumference of the feeding wheel in an axial direction.

7. The electric pencil sharpener as claimed in claim 5, further comprising a roller frame that is mounted to the frame for receiving the roller, wherein the roller frame defines a through-hole therein, the extending portion of the roller extends into the through-hole, the extending portion moves in the though-hole to limit an angle that the roller swings about.

8. The electric pencil sharpener as claimed in claim 7, wherein the roller, the roller frame, and a cap mounted to a front end of the roller frame together form a roller assembly that is removable from the frame, an elastic member is mounted between the roller and the cap.

9. The electric pencil sharpener as claimed in claim 1, further comprising a pencil clamping mechanism, wherein the pencil clamping mechanism comprises a second transmission mechanism driven by a second motor, a second eccenter driven by the gear assembly that is driven by the first transmission mechanism, a draw rod driven by the second eccenter, a set of driven wheels mounted to the draw rod, and a set of drive wheels driven by the second transmission mechanism, wherein the second eccenter drives the driven wheels to move close to the drive wheels, to clamp a pencil.

10. The electric pencil sharpener as claimed in claim 1, further comprising a pencil container, wherein the pencil container is mounted to the frame and located below the roller, for containing sharpened pencils from the roller.

* * * * *